US005767442A

United States Patent [19]

Eisenberg et al.

[11] Patent Number: 5,767,442

[45] Date of Patent: Jun. 16, 1998

[54] NON-SKEW CABLE ASSEMBLY AND METHOD OF MAKING THE SAME

[75] Inventors: Donald Eisenberg, Weston; Carl S. Booth, Storrs; William H. Pendleton, Cheshire, all of Conn.

[73] Assignee: Amphenol Corporation, Wallingford, Conn.

[21] Appl. No.: 577,937

[22] Filed: Dec. 22, 1995

[51] Int. Cl.[6] ..... H01B 3/28; H01B 9/06

[52] U.S. Cl. ..... 174/36; 174/113 R; 174/117 F

[58] Field of Search ..... 174/36, 105 R, 174/113 R, 117 F, 117 AS, 117 A

[56] References Cited

U.S. PATENT DOCUMENTS

| | | | |
|---|---|---|---|
| 265,130 | 9/1882 | Nichols . | |
| 2,158,496 | 5/1939 | George | 174/117 F |
| 2,626,303 | 1/1953 | Link | 174/117 F |
| 2,916,055 | 12/1959 | Brumbach | 138/87 |
| 3,134,843 | 5/1964 | Monelli | 174/88 |
| 3,627,903 | 12/1971 | Plummer | 174/72 A |
| 3,646,247 | 2/1972 | Sennett et al. | 174/117 M |
| 3,775,552 | 11/1973 | Schumacher | 174/105 R |
| 4,096,346 | 6/1978 | Stine et al. | 174/36 |
| 4,097,324 | 6/1978 | Emmel | 156/179 |
| 4,150,249 | 4/1979 | Pedersen | 174/36 |
| 4,209,966 | 7/1980 | Sutor et al. | 57/6 X |
| 4,230,898 | 10/1980 | Emmel | 174/32 |
| 4,381,208 | 4/1983 | Baverstock | 156/52 |
| 4,533,788 | 8/1985 | Pokojny et al. | 174/88 C |
| 4,588,852 | 5/1986 | Fetterolf et al. | 174/36 |
| 4,992,625 | 2/1991 | Izui et al. | 174/36 |
| 5,038,001 | 8/1991 | Koegel et al. | 174/112 |
| 5,287,618 | 2/1994 | Koegel et al. | 29/828 |
| 5,334,271 | 8/1994 | Bullock et al. | 156/51 |

FOREIGN PATENT DOCUMENTS

| | | |
|---|---|---|
| 2-129811 | 5/1990 | Japan . |
| 7-320568 | 12/1995 | Japan . |
| 8-8034 | 1/1996 | Japan . |

*Primary Examiner*—Kristine L. Kincaid
*Assistant Examiner*—Chau N. Nguyen
*Attorney, Agent, or Firm*—Bacon & Thomas

[57] ABSTRACT

A cable assembly includes a plurality of insulated wires that are arranged in groups of one or more wires with adjacent pairs of the groups being interconnected at any given longitudinal location over the length of the cable. Therefore, the cable defines spaced attachment zones and unattached zones for the groups of wires along the length of the cable with each of the attachment zones including the interconnection of only a single pair of the groups of wires, successive attachment zones being spaced by a respective unattached zone and successive attachment zones interconnecting alternating pairs of the groups of wires. All of the wires are preferably encased in a flexible jacket having a substantially circular cross-section. With this arrangement, the wires extend for the length of the cable without skew and yet the overall cable is extremely flexible.

16 Claims, 2 Drawing Sheets

NON-SKEW CABLE ASSEMBLY AND METHOD OF MAKING THE SAME

BACKGROUND OF THE INVENTION

1. Field of the Invention

The present invention pertains to the art of signal transmission and, more particularly, to a cable assembly including a plurality of wires which are interconnected in a staggered fashion to enable the cable to be extremely flexible in all planes while enabling the cable to transmit signals without skew problems. The invention is also directed to the method of making such a cable.

2. Discussion of the Prior Art

There exist various types of cables for use in transmitting signals over varying distances. Each of these types of cables have their associated advantages and disadvantages. For example, a cable which is formed by placing a jacket over a plurality of individually insulated and discrete wires has the advantage that the cable can be made extremely flexible which is beneficial to routing thereof. Unfortunately, unless elaborate measures are taken to assure that the length of each of the cable wires are the identical length such as by pre-attaching the wires to terminal couplings, when the cable is used to transmit data signals with the data being partially delivered over the length of the cable as pulses on each of the wires, the individual data transmissions may not reach their destination at the same time and therefore the overall signal is distorted. This problem occurs because even a slight twisting of some of the wires can alter their overall lengths and, with ever increasing data transmission speeds, it is not uncommon for sequential signals sent over such cables to be untimely matched.

To avoid this problem, generally referred to as skew, it has been common to utilize flat ribbon-type cables in transmitting signals in various embodiments. In these known types of cables, a plurality of parallel arranged and insulated wires are all attached together over the length of the cable through various means including bonding, laminating, extrusion or the like. This attachment arrangement assures that the physical lengths of the individual wires are identical so that skew problems are avoided. Such ribbon cables can be readily mass terminated and also evince great flexibility, but only in two planes and therefore routing thereof, particularly over long distances with numerous obstructions, is generally avoided.

Attempts have also been made to jacket ribbon cable in a round form. Since the mere placing of a jacket over a ribbon cable constructed in the manner described above would result in a cable that would be completely inflexible for all intensive purposes, it has been proposed to laminate together or otherwise interconnect each of the wires at common spaced intervals along the length of the cable and then jacketing the same. This results in a jacketed cable having first and second alternating sections, i.e., either a first section wherein the wires are all interconnected and can be arranged in a flat configuration for mass or gang termination once exposed from the jacket or a second section wherein the wires remain unattached. A typical form of such a cable would have first sections ranging between 1.5–3.0 inches in length which are spaced by respectively second sections each having a length ranging from one to a few feet.

This form of cable has the advantages that it is extremely flexible in all planes over substantially all of its length and therefore has improved routing capabilities, can still be mass terminated at a selected first section thereof and can avoid the skew problems mentioned above. However, in the final jacketed form, a discernible bump or enlargement of the cable exists at each and every first section along the length of the cable. Not only are these enlarged regions aesthetically unappealing, but they tend to define bending points and angles for the cable which does create some undesirable routing restrictions.

Based on the above, there exists a need in the art for a cable assembly that avoids the disadvantages associated with the known prior art, including skew problems, while being uniformly flexible in all directions, as well as a method of making the same.

SUMMARY OF THE INVENTION

The cable assembly of the present invention is particularly designed for the transmission of pulse signals over a plurality of spaced wires without skew, but which is extremely flexible for enhanced routing purposes. To this end, the wires are arranged in groups of one or more wires each. In any given longitudinal location over the length of the cable assembly, only alternating ones of adjacent pairs of the groups of wires are interconnected. Therefore, the cable assembly defines a plurality of longitudinally spaced attachments zones with each attachment zone including the interconnection of only a single pair of the groups of wires. Successive attachment zones are spaced by an unattached zone where none of the groups are interconnected. In addition, successive attachment zones interconnect alternating pairs of the groups of wires in a stepped and staggered fashion.

With this arrangement, all of the groups of wires are interconnected to each other but, at most, any given group is only directly connected to its adjacent groups within attachment zones spaced along the length of the cable assembly. The length of the attachment zones are longer than the length of the unattached zones. By interconnecting the groups of insulated wires in this fashion, the overall cable assembly is extremely flexible so as to evince enhanced routing capabilities yet the physical length of each of the insulated wires can be maintained identical to avoid any skew problems.

The cable assembly can be formed in a flat manner but is preferably placed in a jacket having a substantially circular cross-section. In one preferred embodiment, the cable assembly utilizes twinaxial cable wires with each wire group including two insulated wires, each having a central signal transmitting wire which is surrounded by an insulation core, and a common drain wire. In addition, each group is preferably laminated together with these lamination layers being interconnected through the laminating process, or through extrusion or bonding processes, to interconnect the adjacent pairs of wire groups in the attachment zones. When used as a twinaxial cable assembly, a mylar/aluminum foil, as well as a braiding, is positioned between the groups of insulated wires as a whole and the jacket.

Additional features and advantages of the present invention will become more readily apparent from the following detailed description of a preferred embodiment thereof when taken in conjunction with the drawings wherein like reference numerals refer to corresponding elements and the various views.

DETAILED DESCRIPTION OF THE PREFERRED EMBODIMENTS

Figures 1, 2:
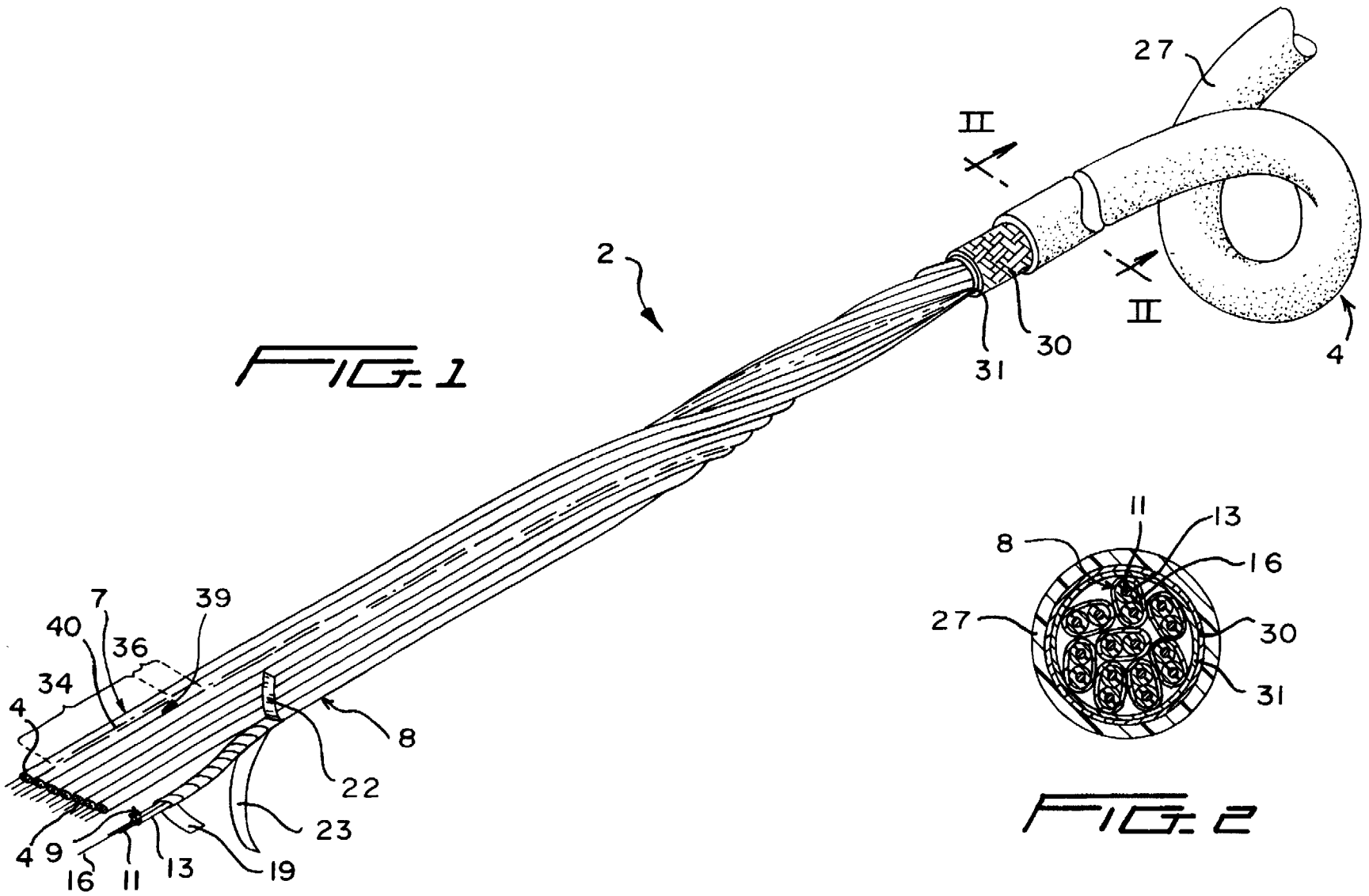
FIG. 1 is a perspective view of a section of cable constructed in accordance with the present invention.
FIG. 2 is a cross-sectional view generally taken along line II—II in FIG. 1.

With initial reference to FIGS. 1 and 2, the cable assembly of the invention is generally indicated at 2 and is comprised of a plurality of insulated wires 4 which are arranged in groups with the first group being indicated at 7 and the last group being indicated at 8. As shown for exemplary purposes, insulated wires 4 are arranged in pairs to form various twinax wires such as at 9. Since the construction of each of the groups of insulated wires 4 are identical, the specific construction of last group 8 will now be described and it is to be understood that the remaining groups are similarly constructed.

As depicted, each twinax wire 9 includes two central, signal transmitting wires 11 each of which is encased in insulation 13. In the preferred embodiment depicted, insulated wires 4 comprise twinaxial cable wires and therefore each group is provided with a common drain wire 16 (only one of which is shown in FIGS. 1 and 2 for clarity of the drawings). The insulated wires 4 and the drain wire 16 of each group are bound together by a shield 19, forming part of a cover arrangement, that is wrapped around these wires. In addition, upper and lower lamination layers indicated at 22 and 23 respectively are applied.

At this point it should be noted that, although these figures indicate the presence of eight groups of insulated wires 4 with each group containing two insulated wires, it is to be understood that the number of groups can vary in accordance with the invention and also the number of insulated wires in each group can vary. Therefore, the number of groups can be more or less than eight and the number of insulated wires 4 in each group can range from a single insulated wire to two or more such wires without departing from the spirit of the invention.

At the left side portion of FIG. 1, the groups of insulated wires 4 have been arranged in a flat manner to illustrate that the invention can be utilized in making a flat cable. However, in accordance with the present invention, it is preferable to encase each of the insulated wires 4 within a flexible jacket 27. In the preferred embodiment, a jacket 27 is formed from an elastomeric material and is substantially circular in cross-section. As the invention is being illustrated with paired twinaxial cable wires, it is also preferable to provide a braiding 30, preferably formed from tinned copper, as well as a metal foil layer 31 (e.g. aluminum/Mylar) between the insulated wires 4 when bundled and the jacket 27.

In accordance with the invention, it is important to note that only alternating ones of adjacent pairs of the groups of insulated wires are interconnected at any given longitudinal location over the length of cable assembly 2. Therefore, at any particular longitudinal location along the length thereof, cable assembly 2 will either define an attachment zone such as that indicated at 34 or an unattached zone as indicated at 36. In each attachment zone 34, only a single adjacent group of insulated wires 4 are interconnected and the remaining groups of insulated wires 4 are unattached to the other groups in this zone. As depicted, attachment zone 34 has interconnected first group 7 with an adjacent second group 39 along attachment line 40. Successive attachment zones 34 will be spaced by respective unattached zone 36. In addition, successive attachment zones 34 interconnect alternating pairs of the groups of insulated wires 4. Therefore, each of the groups of insulated wires 4 along the length of the cable are interconnected in a stepped and staggered fashion with only the first and second groups being interconnected in attachment zone 34 as labeled in FIG. 1, only the second and third groups being interconnected in the next attachment zone, the third and fourth groups being interconnected in the following attachment zone and so on. Therefore, the majority of the groups of insulated wires 4 at any given longitudinal location are free and separate from the other groups with only an adjacent pair of groups being interconnected at any given location. Furthermore, in the preferred embodiment, attachment zones 34 have associated lengths which are greater than the length associated with each of the unattached zones 36.

With this spaced attachment arrangement, which repeats itself over the entire length of the cable assembly 2, the physical length of each of the insulated wires 4 can be maintained identical to assure that skew problems are avoided. In addition, this interconnection arrangement allows cable assembly 2 to be surprisingly flexible such that it can evince enhanced routing capabilities. The flexibility of cable assembly 2 is generally reflected in FIG. 1 by the illustration of curved or looped portion 42.

The various groups of insulated wires 4 can be interconnected along the length of cable assembly 2 as discussed above by means of various assembly methods including lamination, extruding, gluing, heat bonding and the like. In addition, all of the insulated wires 4 could be interconnected by means of a lamination layer(s) which is subsequently slitted to provided the particular arrangement of attachment zones 34 and unattached zones 36. The groups of insulated wires 4 can then be placed in jacket 27 if a round form of the cable is desired.

Figures 3A, 3B, 4A, 4B:
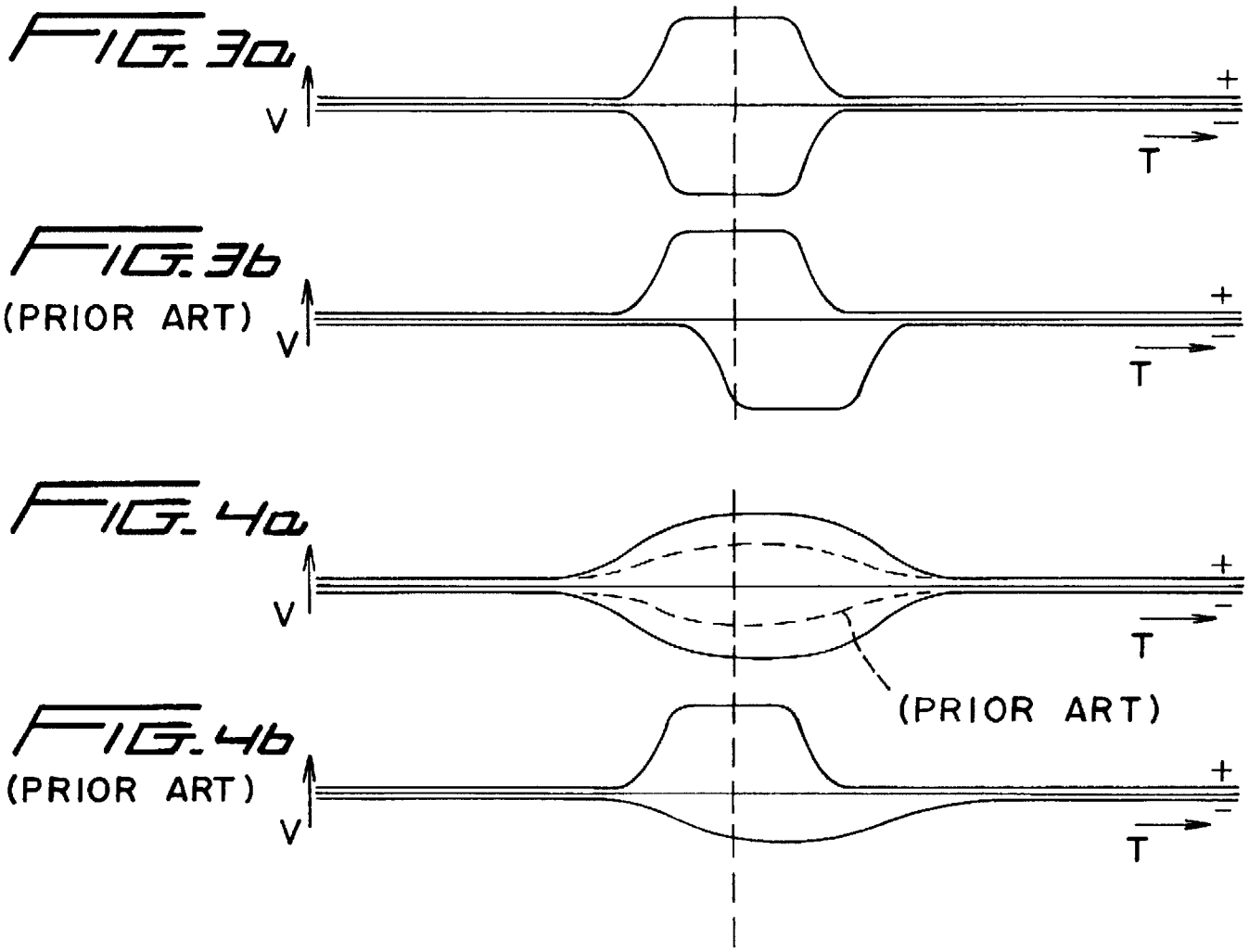
FIG. 3b (PRIOR ART)
FIG. 4b (PRIOR ART)
FIG. 3*a* is a graph of a non-skew signal transmission between two wires.
FIG. 3*b* is a graph similar to that of FIG. 3*a* but illustrating a time delay skew.
FIG. 4*a* is a graph representing signal transmissions with amplitude skew associated with the cable assembly of the present invention versus the prior art.
FIG. 4*b* is a graph similar to that of FIG. 4*a* but illustrating a transmission having an associated time delay skew.

With this construction of cable assembly 2, since the physical lengths of the insulated wires 4 are maintained equal, when cable assembly 2 is used to transmit data signals with data being delivered over the length of the cable assembly 2 as pulses from a transmitter to a receiver, the pulses will arrive at a receiver at the same time. In general, such a receiver measures the difference between positive and negative voltages and either recognizes the presence of a signal or the absence of a signal. This method of transmission is called differential signalling and is dominant in high performance systems. This type of signalling is generally related to within-pair signal transmitting. If the pulses on each insulated wire 4 do not arrive at the same time, this is known as within-pair skew. In multiple pair cables, a pair-to-pair skew, which is the measure of time difference between fastest and slowest signals with each pair being considered to provide a single signal, is also a particular design consideration. FIG. 3*a* represents a time delay skew graph associated with the cable assembly 2 of the present invention wherein it is noted that signals from either within-pair or pair-to-pair signalling results in a properly timed transmission. This is contrary to the type of transmission that would be evinced from a typical twisted wire pair having varying physical lengths which is represented by the graph shown in FIG. 3*b*.

Another aspect of skew that must be a consideration in the design of cables used in high performance data transmission systems is amplitude skew. With respect to this type of skew it is important to relay how much signal voltage is lost at the receiver relative to how much is transmitted. This is generally referred to as "attenuation." Many things can effect a attenuation but a significant contributor thereto is the varying in actual physical length of a wire resulting from the manner in which it is twisted or stretched. In a typical twisted pair wiring arrangement, the twisting will cause an actual physical length of each wire of approximately 2–4 percent greater than a parallel line with this percentage generally depending on the number of twists per inch. This percentage directly affects the current resistance by a similar percentage. Therefore, overall improvements in attenuation can be realized by placing parts in a parallel,untwisted format. Cable assembly 2 of the present invention greatly reduces amplitude skew as compared to the prior art as represented by the graph shown in FIG. 4*a* wherein a known twisted wire pair cable arrangement would have associated leg-to-leg time delay skew plus amplitude skew as represented in FIG. 4*b* respectively. Therefore, cable assembly 2 provides improved attenuation characteristics over such known cable assemblies and therefore will provide for improved data transmission, as well as improved flexibility for routing purposes, versus known cable assemblies.

Although described with respect to preferred embodiments of the present invention, it should be readily understood that various changes and/or modifications can be made to the cable assembly of the present invention, as well as the method of assembling the same, without departing from the spirit thereof. In general, the invention is only intended to be limited by the scope of the following claims.

We claim:

1. A cable capable of laying flat or being encased with a flexible jacket substantially circular in cross-section comprising:

a plurality of longitudinally extending, insulated signal wires arranged in at least first, second and third groups; and means for interconnecting varying ones of said groups at spaced intervals along the length of the cable such that said cable defines various distinct zones that are longitudinally spaced therealong with only said first and second groups being interconnected in a first of said zones, none of said groups being interconnected in a second of said zones which is adjacent said first zone, only said second and third groups being interconnected in a third of said zones which is adjacent said second zone and none of said groups being interconnected in a fourth of said zones which is adjacent said third zone wherein each of said first, second and third groups includes a pair of said insulated signal wires joined by a common cover arrangement and wherein said cover arrangement comprises a shield member wrapped about a respective pair of said insulated signal wires and a film arranged upon the shield member.

2. The cable according to claim 1, further comprising a flexible jacket encasing each of said signal wires.

3. The cable according to claim 2, wherein said jacket is substantially circular in cross-section.

4. The cable according to claim 5, wherein each of said insulated signal wires comprises a twinaxial cable member including two transmission wires each surrounded by an insulation core arranged under said shield member.

5. The cable according to claim 4, further comprising a flexible jacket extending about the cover arrangement of said groups of signal wires and a braiding arranged between said jacket and said groups of signal wires.

6. The cable according to claim 1, wherein said first and third zones have associated lengths each of which is greater than a length associated with each of said second and fourth zones.

7. The cable according to claim 6, wherein said cable includes at least six groups of said insulated wires with only two of said six groups being interconnected at any given longitudinal location along said cable.

8. A cable comprising at least three laterally spaced groups of individually insulated wires with solely alternating ones of adjacent pairs of said groups being interconnected at any given longitudinal location over the length of said cable, wherein each of said groups includes a pair of said insulated wires joined by a common cover arrangement, said cover arrangement comprising a shield member wrapped about a respective pair of said insulated signal wires and a film arranged upon the shield member.

9. The cable according to claim 8, further comprising a flexible jacket encasing each of said signal wires, said jacket being substantially circular in cross-section.

10. The cable according to claim 8, wherein each of said insulated signal wires comprises a twinaxial cable member including two central transmission wires each surrounded by an insulation core arranged under said shield.

11. The cable according to claim 10, further comprising a flexible jacket extending about the cover arrangement of said groups of signal wires.

12. The cable according to claim 11, further comprising a braiding arranged between said jacket and said groups of signal wires.

13. The cable assembly according to claim 8, wherein said cable is divided into a series of first zones wherein one of said adjacent pairs of said groups are interconnected and a series of second zones wherein none of said groups are interconnected, each of said second zones being interposed between respective ones of said first zones, each of said first zones being longer than each of said second zones.

14. The cable according to claim 13, wherein said cable includes at least six groups of said insulated wires with only two of said six groups being interconnected at any given longitudinal location along said cable.

15. A method of assembling a cable capable of laying flat or being encased within a flexible jacket substantially circular in cross-section comprising:

providing a plurality of insulated wires;

arranging said wires in at least three longitudinally extending groups; and providing longitudinally spaced attachment zones and unattached zones for said groups of wires along the length of said cable with each of said attachment zones including the interconnection of only a single pair of said groups of wires, successive ones of said attachment zones being spaced by a respective unattached zone and successive ones of said attachment zones interconnecting alternating pairs of said groups of wires wherein each of said first, second and third groups includes a pair of insulated signal wires joined by a common cover arrangement and wherein said cover arrangement comprises a shield member wrapped about a respective pair of said insulated signal wires and a film arranged upon the shield member.

16. The method according to claim 15, further comprising: encasing all of said plurality of insulated wires in a flexible jacket having a substantially circular cross-section.

* * * * *